United States Patent [19]

Tsumiyama

[11] Patent Number: 4,962,717

[45] Date of Patent: Oct. 16, 1990

[54] MANEUVERING GEAR FOR SMALL BOAT

[75] Inventor: Yoshinori Tsumiyama, Miki, Japan

[73] Assignee: Kawasaki Jukogyo Kabushiki Kaisha, Kobe, Japan

[21] Appl. No.: 254,304

[22] Filed: Oct. 6, 1988

[30] Foreign Application Priority Data

Oct. 7, 1987 [JP] Japan ..... 62-153542[U]
Oct. 7, 1987 [JP] Japan ..... 62-153543[U]
Oct. 7, 1987 [JP] Japan ..... 62-153544[U]

[51] Int. Cl.[5] ..... B63H 25/00

[52] U.S. Cl. ..... 114/144 R; 74/480 B; 440/87

[58] Field of Search ..... 114/144 R, 144 E; 440/42, 43, 38, 84, 86, 87; 74/471 R, 480 B

[56] References Cited

U.S. PATENT DOCUMENTS 1,860,173 5/1932 Colstad ..... 440/87
2,402,724 6/1946 Bidwell ..... 114/144 R
2,858,819 11/1958 Polcari ..... 440/87
3,386,308 6/1968 Butler ..... 74/480 B

FOREIGN PATENT DOCUMENTS 55-22510 2/1980 Japan .

*Primary Examiner*—Joseph F. Peters, Jr.
*Assistant Examiner*—Jesus D. Sotelo
*Attorney, Agent, or Firm*—Marshall, O'Toole, Gerstein, Murray & Bicknell

[57] ABSTRACT

Maneuvering gear for a small boat, comprising a control stick that allows steering and throttle control with a single hand and that is easily adjustable to an optimum height according to the boat size or the maneuvering position of the operator. The control stick may extend substantially erect ahead of a helm seat of the boat, the control stick being supported on the hull so that it may be angularly turned to the right or left in order to maneuver the boat to the right or left. The control stick has a throttle lever near the upper end thereof for controlling the velocity of the boat. The control stick further includes a mechanism for enabling the stick to be folded down.

5 Claims, 7 Drawing Sheets

MANEUVERING GEAR FOR SMALL BOAT

FIELD AND BACKGROUND OF THE INVENTION

The present invention relates to a maneuvering gear for small powered boats and the like, and in particular, it relates to a maneuvering gear which allows the operator to steer the boat and also control the throttle with a single hand, and provides a control stick of an optimum height corresponding to the size of the boat or the steering position of the operator.

In the past, the maneuvering gear of a small boat generally included a circular steering wheel which was supported by a column above the floor and located in front of a helm seat or operator's seat. A throttle lever (accelerator control box) was installed separately on one side of the helm seat or near the steering wheel. The maneuvering gear was arranged in such a way that the operator held and controlled the steering wheel with one hand and controlled the throttle lever with the other hand to control the speed of the boat, thereby effecting the maneuvering (controlling) of the boat.

The maneuvering gear of the above-mentioned configuration, however, was inconvenient in that the operator was constantly forced to use both hands to operate the steering wheel and the throttle lever all the time. To turn a circular steering wheel, the movement of the hand had to be great, thus requiring a considerably wide space around the wheel. This was not appropriate for small compact boats.

Furthermore, since the column supporting the above-mentioned steering wheel was formed as a pillar-shaped rigid body, the steering wheel, etc. would extend from the deck surface to the desired height. Extension of such an object from the deck surface to the desired height would hinder the placement of an awning (or cover) when the small boat was to be covered which was not desirable.

It is a general object of the present invention to avoid the foregoing problems. A maneuvering gear for small boats is provided which allows the operator to both steer the boat and control the engine throttle with a single hand, and easily provides a control stick at an optimum height which corresponds to the boat size or the maneuvering position of the operator.

SUMMARY OF THE INVENTION

A maneuvering gear for a small boat according to the present invention includes, in one embodiment of the invention, a control stick arranged to stand in front of the helm seat. The control stick includes an upper grip portion, an intermediate portion, and a lower base portion. The control stick is supported by the hull so that it can be pivoted freely to the right and left to steer the boat to the right and left, respectively. Furthermore, a throttle mechanism for controlling the speed of the boat is provided on or around the upper grip portion of the control stick.

According to another embodiment of the present invention, the maneuvering gear for a small boat has an intermediate portion made of a pipe, and the intermediate portion is freely connected to and disconnected from the base portion.

The maneuvering gears thus configured allow the operator to steer the boat to the right or left by holding and turning the control stick to the right or left with a single hand, and to control the velocity of the boat by controlling the throttle mechanism with fingers of the same hand. In addition, a control stick suited to the size of the boat or the elevation of the helm seat can be obtained by merely changing the length or the curve of the pipe portion of the control stick.

Further, in another embodiment of the present invention, the maneuvering gear for a small boat has a joint formed in the intermediate portion whereby the portion above the joint is capable of being bent to and fro relative to the portion below the joint. The present maneuvering gear of the above-mentioned configuration may be used for maneuvering the boat by securing the joint in an inflexible manner, and when it is not in use, any extension of the maneuvering gear above the desired height of the deck, etc. may be avoided by folding or bending the stick at the joint. Accordingly, if the bending portion is arranged below the desired height (for example, the top of the deck) and the stick is made flexible so that its portion above the bending portion comes below the bending portion when the stick is bent at the bending portion, no portion of the maneuvering gear (the control stick) ever extends above the desired height.

In still another embodiment of the maneuvering gear for a small boat according to the present invention, flexible lead wires of a relatively low rigidity are passed through the joint portion in the back side of the joint with a considerable margin in the length. The throttle cable having a relatively high rigidity is fixed to the stationary part and is arranged through the joint in its belly side in such a way that the cable can freely slide over.

In the present maneuvering gear of the foregoing configuration, when the control stick is bent in the middle, the fixed portion of the throttle cable smoothly moves downwardly by the compressive force generated by the bending in the belly side of the joint. Furthermore, in the back side of the joint, where a tensile force is generated, the tensile force is smoothly accommodated by using up the marginal length of the lead wire to avoid any excessive force from being exerted to the wires passing through the joint. The control stick, therefore, is capable of freely bending at the joint.

DETAILED DESCRIPTION OF THE DRAWINGS

Figure 1:
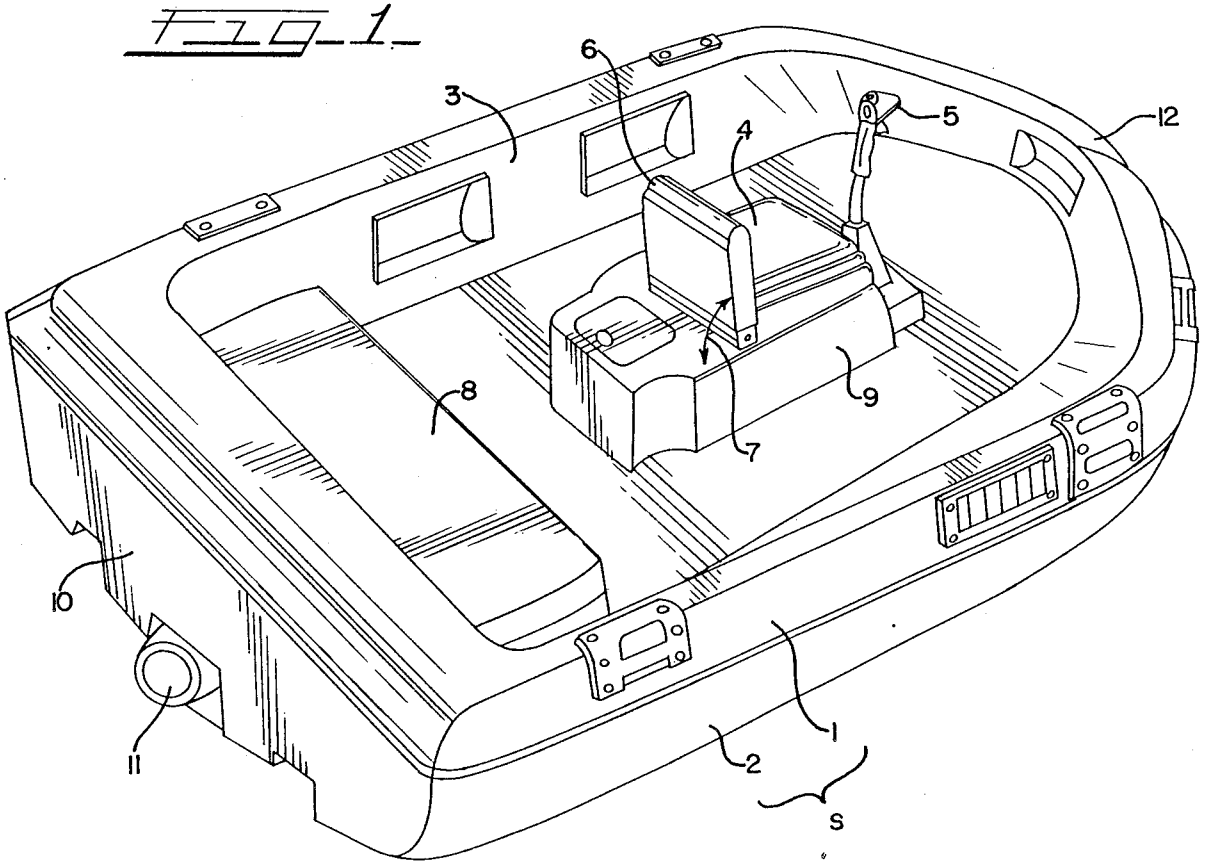
FIG. 1 is a perspective view of a small boat including maneuvering gear in accordance with a first embodiment of the present invention.

With reference to FIG. 1, the hull S of the small boat comprises an upper deck 1 and a bottom hull 2. Inside is formed an operator and passenger area 3 formed by the deck 1 and the hull 2, and a helm seat 4 is provided in the area 3. The helm seat 4 is located in the front half of the hull 2, and in the middle between the sides. A control stick 5 is provided ahead of the helm seat 4 and also close to the helm seat 4. The helm seat 4 has a back 6 which may be erected as shown in the drawing or may be folded down as shown by the arrow to make it substantially flush with the helm seat 4. The helm seat is fixed onto a cover 9 for an engine enclosure. Behind the helm seat 4, a passengers' seat 8 for two or more persons is provided.

Beneath the cover 9, an engine is provided, although it is not illustrated in the drawing. The engine is arranged to propel the boat by rotating the propeller of a water jet pump (jet pump) 46 (see FIG. 2) which is provided with a nozzle 11 for jet propulsion, the nozzle 11 being installed in the stern 10 (see FIG. 1).

The above-mentioned control stick 5 is installed ahead of the helm seat 4 as mentioned above, and is arranged in such a way that an operator seated in the helm seat can angularly displace the control stick 5 to the right or left with a single hand in order to steer the boat and change the direction of the bow 12, the upper end of the control stick extending a little above the top of the deck 1. Thus maneuvering requires only a limited space. The top portion of the control stick 5 is a little above the upper level of the deck 1, and is capable of being folded forwardly so that it does not hinder packing or shipping of the small boat.

FIGS. 2 to 5 show the maneuvering gear in more detail. The control stick 5 includes a grip portion 22 having a switch mounting part 21 at the upper end of the stick, a lower base portion 24, and a pipe portion 23 which connects the grip portion and the base portion. The control stick 5 is generally in the shape of a sturdy stick, and is preferably shaped to gradually bend or slant forwardly from the pipe portion 23. The cap-shaped switch mounting part 21 protrudes forwardly from the top of the grip portion, and the overall assembly is in the form of an inverted L.

A starter switch 27 and a stop switch 28 are arranged, in this order from the top, on the surface of the switch mounting part 21 which is toward the aft or operator's side. A trigger type throttle lever 26 is also provided on the fore side of the upper portion of the control stick.

The above-mentioned grip portion 22 and the base portion 24 are preferably formed of aluminum split-in-two castings. The pipe portion 23 is preferably made of tubular aluminum or stainless steel and is provided between and connected to the grip portion and the base portion.

The base portion 24 has a rearwardly extending projection 24*a* and a lower mounting part 25. The projection 24*a* stores a reel 60, etc. which will be described later. The mounting part 25 of the base portion 24 has bolt holes 31 through which bolts are passed and screwed into nuts 32 fixed to a flange 33.

A shaft 35 is secured to the flange 33, and the shaft 35 is supported by plain bearings 34 and 36 mounted on a base 37. The base 37 is fixed to the hull S (FIG. 1) of the boat so that the shaft 35 extends substantially parallel to the longitudinal axis of the boat. The control stick 5 is thus arranged to freely turn to the right and left on the axis 35*a* of the shaft 35.

Figure 2:
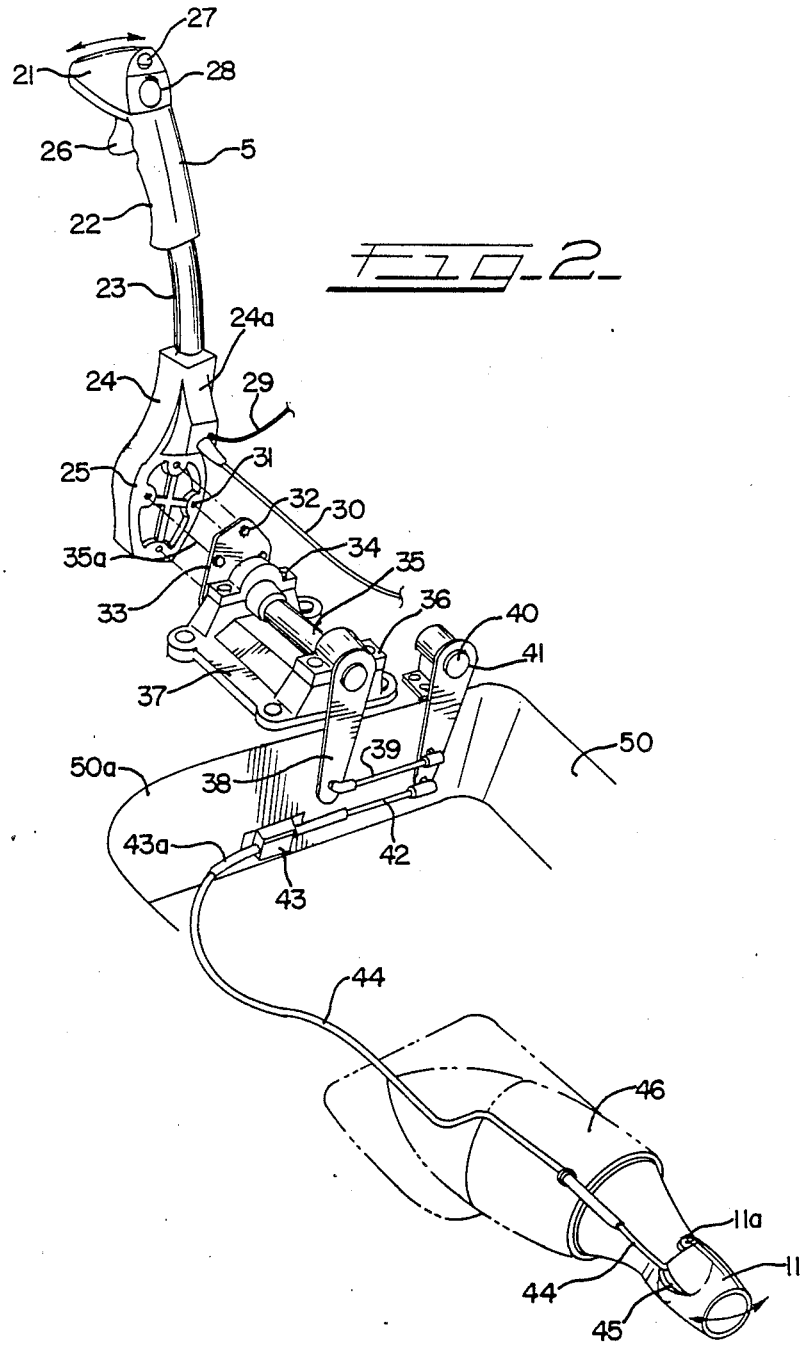
FIG. 2 is a perspective exploded view illustrating a coupling structure between the maneuvering gear of the first embodiment and the steering gear in the stern of the boat.

One end of the above-mentioned shaft 35 is fixed to the top end of an arm 38. One end of a link or rod 39 is pivotally connected to the bottom end of the arm 38, and the other end of the rod 39 is pivotally connected to the bottom end of another arm 41. The top end of the arm 41 is pivotally supported by a support shaft 40 which is pivotably supported by the hull S (FIG. 1). The two arms 38 and 41 are suspended along a front wall 50*a* which forms a recess 50 beneath the helm seat 4 (FIG. 2). One end of another rod 42 which runs in parallel with the rod 39 is pivotally connected to the bottom end of the arm 41. The other end of the rod 42 is inserted into a cable sheath or case 43*a* which is supported by a cable bracket 43 fixed on the front wall 50*a*. Inside the cable case 43*a*, the other end of the rod 42 is connected to one end of a steering cable 44. The cable 44 runs through the case 43*a* and the other end of the steering cable 44 is connected to one side 45 of the nozzle 11 which is located in the stern 10.

The above-mentioned nozzle 11 is supported on the hull by a vertically extending pin fastened to a nozzle support member 11*a* so that the nozzle can be turned angularly to the right and left relative to the aft end of the boat.

The starter switch 27 which is installed on the head of the control stick 5 functions to connect electric power to a starter motor for starting an internal combustion engine located on the hull beneath the helm seat 4. The stop switch 28 functions to turn off the power to the ignition system of the internal combustion engine when it is pressed. The internal combustion engine drives the water jet pump 46, and the water jet pump 46 jets water out of the nozzle 11 to provide a propulsive force.

The operator is seated on the helm seat 4. The operator holds the grip portion 22 of the control stick 5 with one hand, and adjusts the setting of the throttle valve of the carburetor of the internal combustion engine and in turn the propulsive force of the boat by angularly turning the trigger type throttle lever 26 towards or away from the grip portion 22 with the index finger. To stop the boat, the operator pushes down the stop switch 28 mounted on the top of the grip portion of the control stick 5. The switch 28 then turns off the ignition system of the engine, and the engine and the boat stop.

If the control stick 5 is turned angularly, the shaft 35 will be turned angularly to the right or left on the shaft axis 35*a*. This in turn will swing the arms 38 and 41 angularly, resulting in a horizontal displacement of the rod 42 to the right or left. This displacement will be transferred by the steering cable 44 to angularly turn the nozzle 11 on the nozzle support member 11*a*. This operation will turn the bow to the right or left, effecting a turning maneuver of the boat. When the control stick is set upright or vertical, the direction of the nozzle 11 will be aligned with the longitudinal direction of the hull S, and the boat will move straight ahead.

Through the use of the above-mentioned maneuvering gear, the nozzle 11 is turned angularly on the nozzle support member 11*a* by an arc corresponding to the angular displacement of the control stick 5. Since the maneuvering of the boat is thus achieved by controlling the angular displacement of the control stick, a large space is not required for steering, in contrast with the use of a circular steering wheel as in the prior art. Furthermore, maneuvering of the boat requires only a limited range of movement of one hand.

Figure 3:
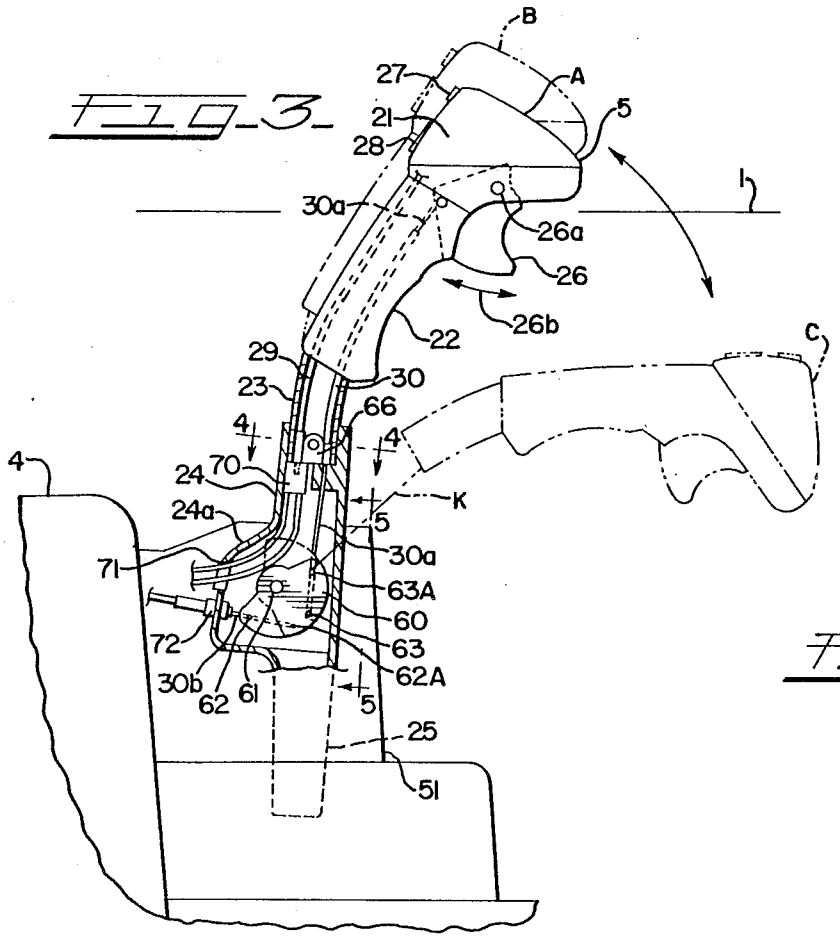
FIG. 3 is a partial sectional side view of the maneuvering gear of the first embodiment.

FIG. 3 is a side view showing additional details of the maneuvering gear. The throttle lever 26 extends partially into both the switch mounting part 21 and the grip portion 22, and it is angularly rotatable on a support pivot shaft 26*a*, as indicated by the arrow 26*b*. One end of the inner cable 30*a* of the throttle cable 30 is connected to the throttle lever 26.

The top end of the pipe 23 of the control stick 5 is inserted into and secured to the grip portion 22, and the bottom end of the pipe 23 is inserted into and secured to the base portion 24.

Figure 4:
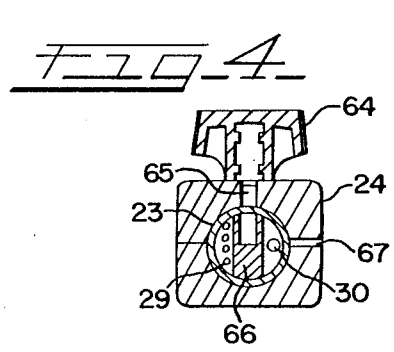
FIG. 4 is an enlarged sectional side view along the line 4—4 of FIG. 3.
Figure 5:
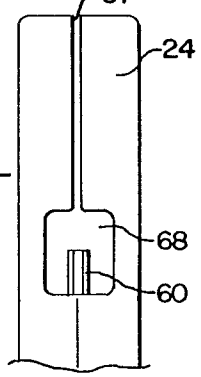
FIG. 5 is a view taken on the line 5—5 of FIG. 3.

As shown in FIG. 4, which is an enlarged sectional view of the base portion 24 on the line 4—4 of FIG. 3, crossing the upper part of the base portion, the base portion 24 is split or divided into two parts. When they are fastened together, a circular cavity or hole for inserting the pipe 23 is formed in the upper part. In the upper part of the assembly, a slot 67 is provided, which just allows the inner cable 30*a* of the throttle cable 30 (FIG. 3) to pass through. As shown in FIG. 5, which is a view of the base portion 24 in the direction 5—5 of FIG. 3, a rectangular opening 68 connected to the slit 67 (see FIG. 4) is provided in such a way that the upper portion of a reel 60, which will be described later, is observable through the opening. This opening 68 allows the inner cable 30*a* (FIG. 3) of the throttle cable 30 to be disconnected from the reel 60. This in turn allows the control stick 5 to be disconnected.

As shown in FIG. 3 and FIG. 4, a fixing member 66 is fastened to the inner wall of the lower part of the pipe 23, the fixing member providing spaces for passing the lead wires 29 and the throttle cable 30 in both ends. The fixing member 66 is provided with a threaded hole. When the pipe 23 is inserted into the hole of the base portion 24, a bolt 65 fixed to a knob 64 is screwed into the threaded hole of the fixing member 66 to secure and prevent the pipe 23 from coming out upwardly. The lower part of the base portion 24 is contained in a box 51 fixed to the hull S.

With reference to FIG. 3, the nearly sectoral or semicircular reel 60 is rotatably mounted on a shaft 61 inside the projection 24*a* in the lower part of the base portion 24. A cable end 63 at one end of the inner cable 30*a* installed inside the control stick 5 is fastened to the reel 60. On the other hand, the end of the sheath of the throttle cable 30, which is to be installed in the hull side, is fixed to the base portion 24 with a grommet 72. The cable wire end 62 of the inner cable 30*b* of the throttle cable is connected to the reel 60. The lead wires 29, which are installed in the hull side, are guided through a grommet 71 provided in the projection 24*a* of the base portion 24 and introduced into the base portion 24, and connected to a connector 70 provided in the upper part of the base portion 24. The lead wires 29, which are installed above the pipe portion 23 of the control stick 5 are inserted into and connected to the connector 70.

Regarding the arrangement for tilting the control stick 5 forwardly, the control stick 5 is normally in the position A shown in solid lines, extending slightly from the upper level of the deck 1. The knob 64 (FIG. 4) is turned to loosen and remove the bolt 65 from the fixing member 66. Then the control stick 5 is pulled up to the position B (dash-dot lines) of FIG. 3 to disconnect the lower end of the pipe 23 from the fitting part of the base portion 24. The lead wires 29 are disconnected from the connector 70, and the reel 60 inside the base portion 24 is turned counterclockwise as seen in FIG. 3 by the inner cable 30*a*, and its cable end 63 comes to a position 63A. The other cable end 62 also comes to a position 62A. Next, the control stick 5 is tilted from the position B to the position C which is lower than the deck 1. The inner cable 30*a* passes through the slit 67 of the base portion 24 and comes to the position K. Thus the control stick 5 may be tilted forwardly to a position below the deck 1 without any difficulties. With this arrangement, the deck 1 is free of any extensions from it, thereby facilitating covering, packing and shipping of the boat.

In an arrangement wherein the control stick is arranged to be slidable up and down at the coupling between the pipe and the base portion, the height of the control stick may be adjusted easily for individual operators.

A second embodiment of the maneuvering gear for a small boat according to the present invention is shown in FIGS. 6, 7, 8, 9, 10 and 11 wherein parts corresponding to those of the first embodiment are indicated by reference numbers which are the earlier numbers plus 100.

Figure 6:
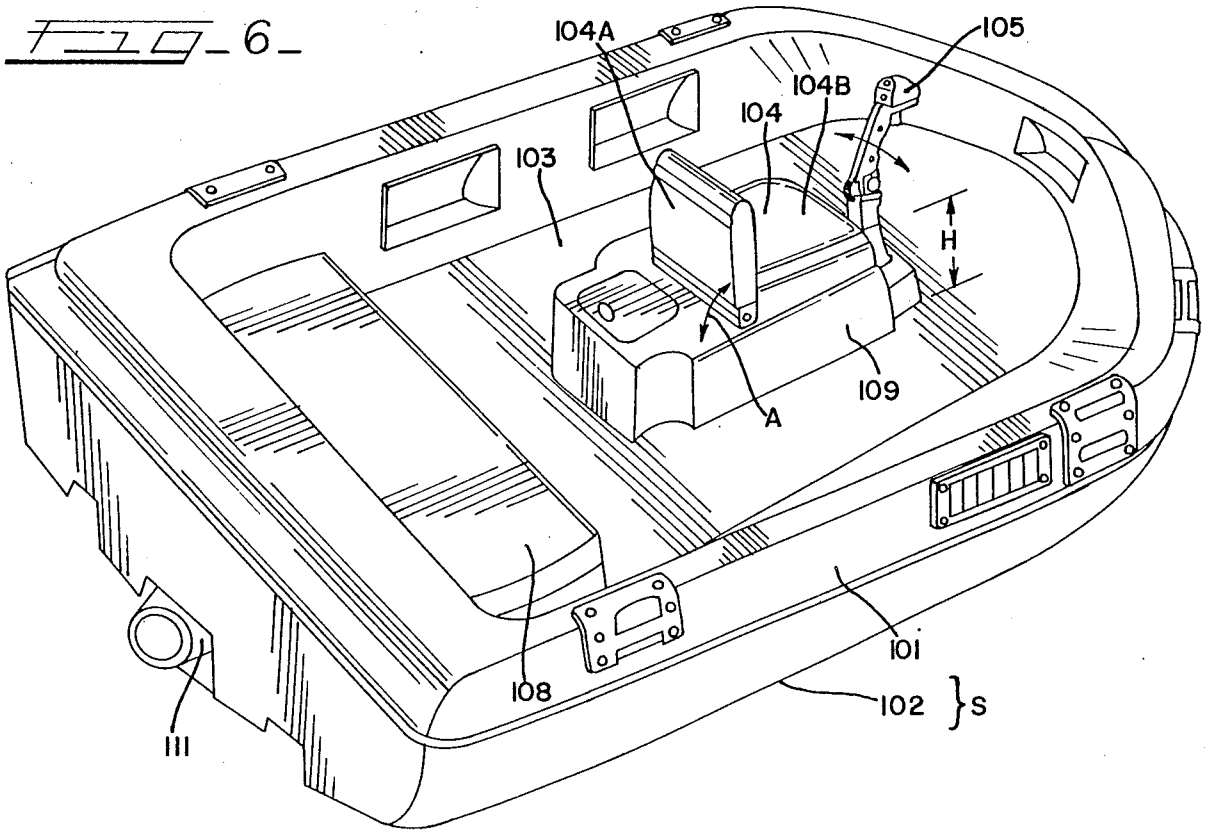
FIG. 6 is a perspective view of a small boat including apparatus in accordance with a second embodiment of the present invention.
Figure 11:
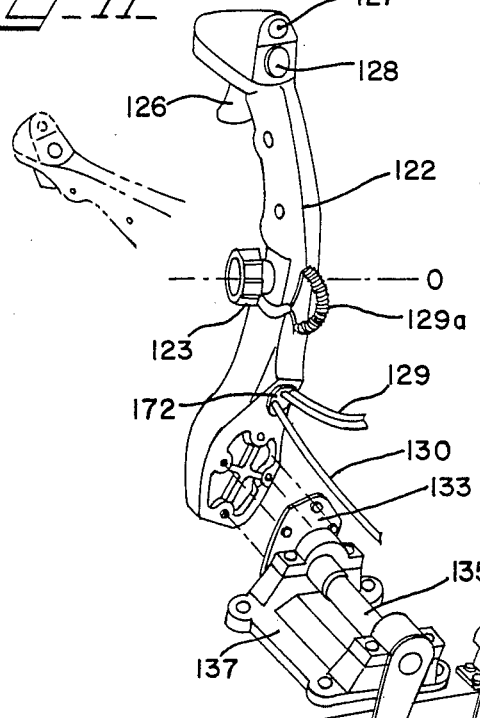
FIG. 11 is an exploded perspective view illustrating the coupling structure between the maneuvering gear of the second embodiment of FIG. 8 and the steering gear in the stern.

As shown in FIG. 6, the second embodiment of the maneuvering gear is generally the same as the above-mentioned first embodiment in the following features: a control stick 105 is located ahead of a helm seat 104; as shown in FIG. 11, the control stick 105 is fixed to the hull by a base 137 so that the stick can be angularly turned sideways on a shaft 135; turning of the stick on this shaft 135 is transmitted through arms 138 and 141, a rod 139, and a steering cable 144 to turn a nozzle 111, which is pivotally connected to the cable at a side end 145, for pivotal movement on the axis of a nozzle vertical pivotal support member 111*a*, effecting maneuvering the boat to the right and left; further, as shown in FIG. 11, a grip portion 122 at the upper part of the control stick 105 is provided with a push button type starter switch 127, a stop switch 128, and a trigger type throttle lever 126.

Figure 7:
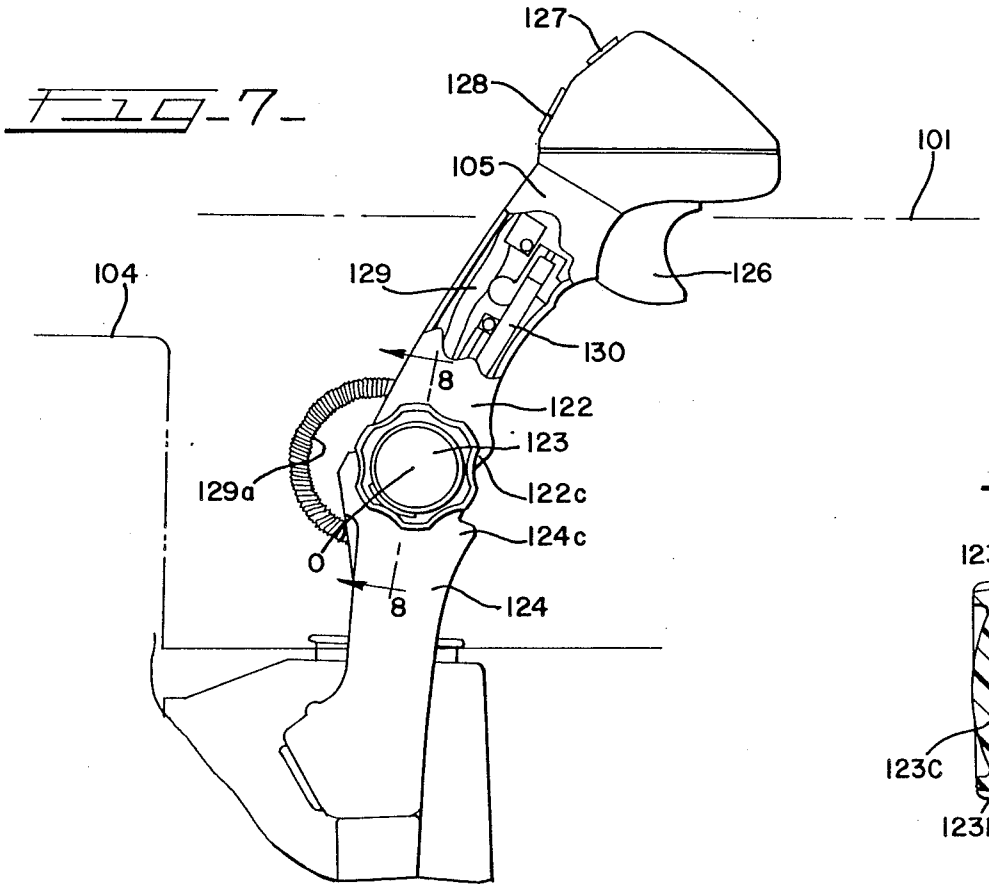
FIG. 7 is a side view partially in section of the maneuvering gear of the second embodiment.
Figure 8:
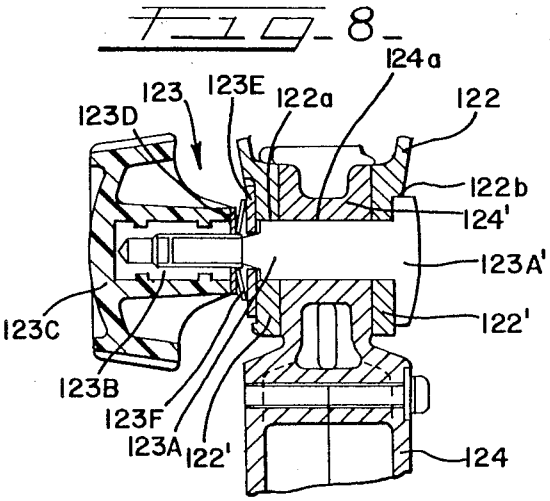
FIG. 8 is a sectional view along the line 8—8 of FIG. 7, illustrating the structure of a joint of the maneuvering gear of the second embodiment.
Figure 10:
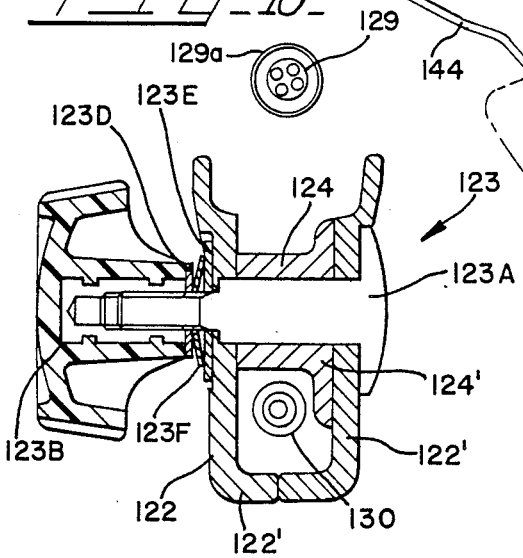
FIG. 10 is a sectional view along the line 10—10 of FIG. 9.
Figure 10:
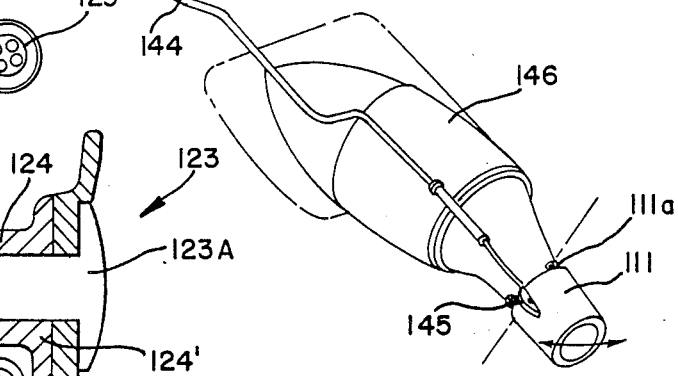

As illustrated in FIG. 7 and FIG. 11, this maneuvering gear is provided with the rod-shaped control stick 105, and a flexible joint 123 is formed in the intermediate part of the control stick 105. In the present embodiment, the joint 123 is formed, as shown in FIG. 7, so that its axis of bending or pivotal movement is a little below the top of the helm seat 104. In this joint, as illustrated in FIG. 8 and FIG. 10, the lower end 122 of the grip portion 122 on the top of the control stick 105 is forked, and the top end 124' of the lower base portion 124 is formed into a projection suited to fit into the space formed by the forked lower end 122' of the upper grip portion 122. Further, the projection of the lower base portion 124 fits into the forked part of the upper grip portion 122, and a bolt 123A is positioned through bolt holes 122*a* and 124*a* of the overlapping two members 122 and 124.

A nut 123*b* is screwed to the top end of the bolt 123A, whereby the two members may be flexibly connected with each other.

On the head 123A' of the bolt 123A is provided means for preventing turning of the bolt. A flat portion (see the upper side of the head 123A' of the bolt 123A in FIG. 8) is formed on the head which engages a surface 122*b* formed on the grip portion 122 on the top of the control stick.

The above-mentioned nut 123B is covered with a noncircular plastic material which is formed into a knob 123C for securing in place or making the joint 123 freely rotatable. To secure the tightening of the knob 123C for securing the joint at any desired position, a Belleville spring 123F with flat washers 123D and 123E on opposite sides of the spring 123F are placed between the nut 123B and the grip portion 122.

Furthermore, as shown in FIG. 7, on the front side of the joint 123, a stop part 122*c* is formed on the lower end of the grip portion 122 on the control stick, and a corresponding stop part 124*c* on the upper end of the lower base portion 124, with a space between the two contacting parts. The maximum angle of bend is obtained when these two stop parts come into contact with each other.

Figure 8A:
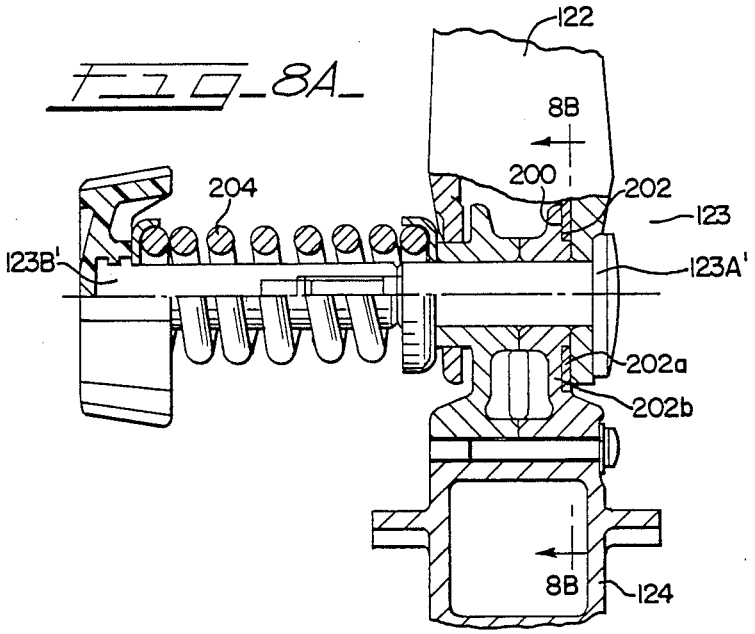
FIGS. 8A to 8D are views of joints of other embodiments of the invention, which are generally similar to the joint of FIG. 8.
Figure 8C:
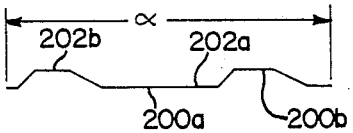
Figure 8D:
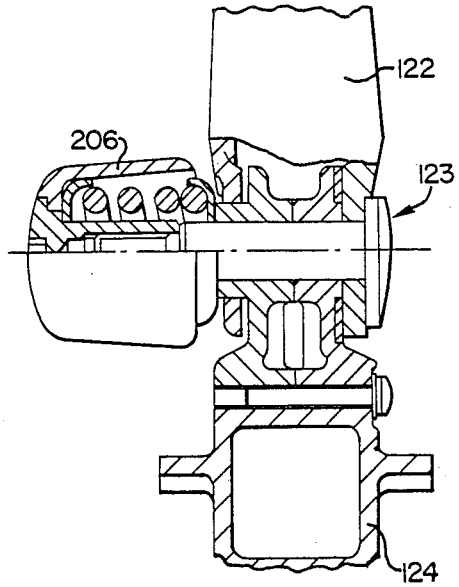
Figure 8B:
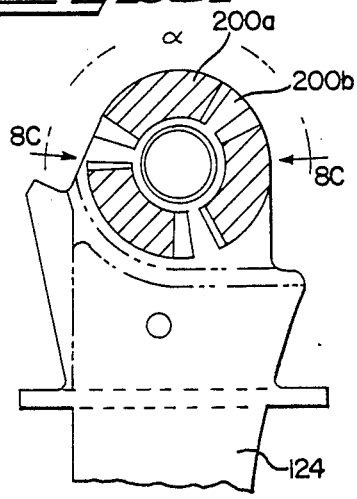

Furthermore, in place of the joint structure 123 shown in FIG. 8, a modification may be provided as shown in FIGS. 8A to 8C. FIG. 8A is a sectional view similar to FIG. 8; FIG. 8B is a view taken on the line 8B—8B of FIG. 8A; and FIG. 8C is a view taken on the line 8C—8C of FIG. 8B. In FIG. 8A, both contact surfaces 200, 202 of the joint 123 between the lower end of grip portion 122 and the upper end of the lower base portion 124, concaves 200*a*, 202*a* and convexes 200*b*, 202*b* in a radial direction (see FIG. 8B), which are engageable to each other (FIG. 8C), are respectively formed.

A spring 204, which fastens the grip portion 122 and the lower base portion 124 to each other, is disposed between a bolt 123A' and nut 123B', whereby if a certain turning force is exerted on the grip portion 122, the grip portion 122 may be revolved relative to the lower base portion 124. That is to say, where the certain turning force is exerted on the concaves 200*a*, 202*a* and convexes 200*b*, 202*b* and they engage each other, the convexes of one of the surfaces may ride on the concaves of the other surface to revolve the grip portion 122 relative to the lower base portion 124, against the spring force of the spring 204. In addition, as shown in the further embodiment of FIG. 8D, it is desirable to provide a case 206 over the spring 204 in order to cover it.

With reference again to FIGS. 7 and 8, the upper grip portion 122 and the lower base portion 124 of the above-mentioned control stick 105 are hollow, and as shown in FIG. 7, lead wires 129 which are connected to the starter switch 127 and the stop switch 128 at the top end of the control stick 105, and the covered throttle cable 130 of which top end is connected to the throttle lever of the grip portion 122, are passed through the hollow interiors.

Figure 9:
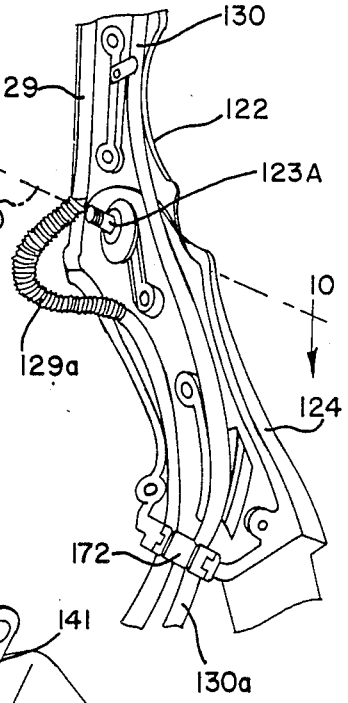
FIG. 9 is a partial side view of the joint of the control stick with some parts broken away to illustrate the wiring configuration of the joint of FIG. 8.

At the above-mentioned joint 123, as shown in FIG. 9, the throttle cable 130 is arranged in the hollow interior on the belly side (the side of which angle is reduced when the joint is bent; the right-hand side as seen in FIG. 9). The outer cable 130*a* of this throttle cable 130 is fastened to the inner wall of the control stick 105 by a grommet 172 at the lower end of the control stick 105 in such a way that the outer cable is freely slidable in the axial direction. With this arrangement, when the joint 123 is bent, the throttle cable 130 is allowed to freely move downwardly by a distance corresponding to the angle of bend. The grommet 172, as shown in FIG. 9, also holds lead wires 129 together with the throttle cable 130.

Furthermore, at the joint 123, the lead wires 129 extend out of the control stick 105 through an opening formed in the back side (the side at which the angle is increased when the stick joint is bent; the left-hand side as seen in FIG. 9), and a coil spring 129*a* is provided around the extruding portion of said lead wires 129 to guide the lead wires 129.

The lead wires 129 extending from the control stick 105 have an extra margin of length on the helm seat side (slightly slackened state) when the stick is not bent so as to avoid any strains from being exerted on the wires when the stick is bent.

A maneuvering gear thus arranged operates as follows: to maneuver the boat, the joint 123 (FIGS. 7 and 8) of the control stick 105 is fixed in any desired position [in the nonbent position (FIG. 7) or in any desired bent position]by turning the knob 123C in the tightening direction. When the boat is not in use, the knob 123C is turned in the loosening direction, and the control stick 105 is bent forwardly at the joint 123 as shown by the dash-dot-dot lines in FIG. 11. When the joint is bent, the slightly slackened lead wires 129, which are arranged on the back side of the joint 123 and are guided by the coil spring 129*a*, will lose its slack because of the increased distance of wiring. On the other hand, as for the throttle cable 130 arranged in the belly side, the portion of the cable held by the grommet 172 will shift downwardly.

Hence, as illustrated in FIG. 11, when the control stick 105 is turned from the nonbent state (see the solid lines of FIG. 11) to the bent state (see the dash-dot-dot lines of FIG. 11), the back side of the joint 123, which is displaced from the axis 0 of bend will be stretched, and the lead wires 129 which have a relatively low rigidity (are flexible) will be subjected to a tensile force. The force will be cancelled out by the extension of the marginal length, and the lead wires will not be directly strained.

The belly side, which is also displaced from the axis 0 of bend, is compressed, and the throttle cable 130 having a high rigidity will be subjected to a compressive force. As explained above, the portion of the throttle cable 130 being held by the grommet 172 will slide downwardly (out of the control stick), and the throttle cable itself will not be directly compressed.

As for the degree or extent of the above-mentioned bending, in the case of the present embodiment shown in FIGS. 6 to 11, the portion of the control stick 105 above the joint 123 is bent forwardly relative to the lower portion till the respective stop parts 122*c* and 124*c* come into contact with each other (80 degrees approximately). In this bent condition, the control stick 105 rests in a position below the height H of the seat of the helm seat 104 (see FIG. 6).

When the boat is to be maneuvered (operated), the control stick is straightened from the bent condition to the nonbent state (or to any intermediate bent state) without any undesirable strain or compression being exerted to the lead wires or the throttle cable due to effects opposite to those described above.

Thus, when wires (lead wires, cables, etc.) having a relatively high rigidity are held slidably on the belly side of the bending portion and the wires etc. having a relatively low rigidity are held on the back side of the bending portion with some margin in length, the joint may be bent very smoothly, and no undesirable forces will be exerted on these wires.

Furthermore, as is the case with the present embodiment, covering the lead wires having a low rigidity with a coil spring 129*a* gives some elasticity to the lead wires, making the lead wires more resistant to deformation due to frequent bending operations.

Fixing the control stick in a slightly bent condition to adjust it the size of the operator may allow the operator to drive (maneuver) the boat in his or her most comfortable position.

In the present embodiment, the helm seat 104 is located in the front half of the hull S, and midway between the sides of the boat. The helm seat 104 has a back 104A which may be erected as shown in FIGS. 1 and 6 or may be turned angularly as shown by the arrow A (see FIG. 6) to make it flush with the seat portion 104B of the helm seat 104. Accordingly, in the present embodiment, the control stick 105 may be set below the height of the helm seat 104 as explained above to keep the helm seat free of anything protruding upwardly from the seat; thus the seat 104 may be used as a table.

Since the above-mentioned control stick may be bent at the joint in the middle, the boat may be made free of any objects protruding upwardly when the boat is not in use. This makes it easy to put an awning on the boat or to pack the boat for transport. Further, when the boat is in use, the helm seat may be used as a table for meals, etc.

According to the present invention, as described above, the boat may be maneuvered with a control stick which does not require a large space around it in contrast with the conventional circular steering wheel. This is desirable for small boats which require a careful or rational layout of components.

The boat may be maneuvered by holding the control stick with a single hand and angularly turning the control stick to the right or left to steer the boat to the right or left, and with the hand in this position, the velocity of the boat may be controlled by manipulating the throttle means with fingers of the same hand.

When the intermediate portion of the control stick is a pipe, as is the case of the first embodiment of the present invention, a control stick appropriate to the boat size or the elevation of the helm seat may be obtained by simply changing the length or the curve of the pipe portion of the control stick, leaving the grip portion and the base portion intact. When the control stick is arranged to be able to be tilted on a joint to a position below the deck level as is the case of the above-mentioned embodiment of the present invention, it is convenient for covering the boat or packing and transporting the boat.

Furthermore, when the control stick has a configuration like that of the second embodiment of the present invention, the wiring arrangement allows smooth bending at the joint of the control stick, and does not exert any undesirable forces to the wire portions passing the joint. Thus a control stick, which is bendable in the middle and is suited to small boats, may be adopted.

What is claimed is:

1. A maneuvering gear for a small boat, comprising a hull, a helm seat mounted on said hull, a control stick on said hull ahead of said helm seat, said control stick comprising an upper grip portion, an intermediate pipe portion, and a lower base portion, mounting means for supporting said base portion on the hull so that the stick is angularly turnable to the right or left in order to maneuver the boat to the right or left, said lower base portion having an opening therein and said pipe portion being removably attached in said base portion, lever means adjacent said grip portion on the top of said control stick, reel means movably mounted on said lower base portion adjacent said pipe portion, and cable means connected to said lever means and removably connected to said reel means.

2. A maneuvering gear for a small boat as set out in claim 1, wherein said pipe portion is freely connectable to and removable from said base portion.

3. A small boat, comprising a hull, a propulsion engine mounted on said hull, a seat mounted on said hull, a control stick mounted on said hull ahead of said seat, said control stick including an upper portion and a lower portion, pivot mounting means connecting said lower portion of said stick to said hull such that said stick may be pivoted sideways to steer the boat, foldable hinge means on said stick between said upper and lower portions thereof for enabling said upper portion to be folded downwardly relative to said lower portion, engine control means mounted on said upper portion, and cable means connected to said engine control means and extending past said foldable hinge means to said engine for controlling operation of said engine.

4. A maneuvering gear for a small boat as set out in claim 3, and further including an engine switch mounted on said upper portion, and lead wires of a relatively low rigidly pass adjacent said hinge means and are installed on the back side of said hinge means with a margin in length, and wherein said cable means has a relatively high rigidity and is installed on the belly side of said joint.

5. A small boat as set out in claim 3, wherein said cable means comprises a bowed portion around said hinge means.

* * * * *